US008102239B2

(12) United States Patent
Woo

(10) Patent No.: US 8,102,239 B2
(45) Date of Patent: Jan. 24, 2012

(54) SMART KEY FOR VEHICLES AND TELEMATICS SYSTEM USING THE SAME

(75) Inventor: Jae Hyun Woo, Seoul (KR)

(73) Assignee: Hyundai Motor Company, Seoul (KR)

( * ) Notice: Subject to any disclaimer, the term of this patent is extended or adjusted under 35 U.S.C. 154(b) by 435 days.

(21) Appl. No.: 12/464,681

(22) Filed: May 12, 2009

(65) Prior Publication Data

US 2010/0001830 A1 Jan. 7, 2010

(30) Foreign Application Priority Data

Dec. 17, 2007 (KR) ..... 10-2007-0132836

(51) Int. Cl.
*G08B 21/00* (2006.01)

(52) U.S. Cl. ..... 340/5.6; 340/426.13; 340/5.72

(58) Field of Classification Search ..... 340/5.6–5.67, 340/5.72, 426.1–426.36, 933; 455/41.2
See application file for complete search history.

(56) References Cited

U.S. PATENT DOCUMENTS

2005/0068159 A1 3/2005 Hung

FOREIGN PATENT DOCUMENTS

KR 10-2007-0035357 3/2007

*Primary Examiner* — Jeffery Hofsass
(74) *Attorney, Agent, or Firm* — Edwards Wildman Palmer LLP; Peter F. Corless

(57) ABSTRACT

The present invention provides a smart key for vehicles and a telematics system using the same. The smart key includes a Radio Frequency (RF) Interface (I/F) unit, a smart key unit, a Universal Subscriber Identity Module (USIM), a USIM I/F unit, and a microcontroller.

14 Claims, 6 Drawing Sheets

SMART KEY FOR VEHICLES AND TELEMATICS SYSTEM USING THE SAME

BACKGROUND

1. Technical Field

The present invention relates generally to a telematics system and, more particularly, to a smart key for vehicles and a telematics system using the smart key.

2. Background Art

Conventionally, a telematics terminal mobile phone number is different from a user's mobile phone number. Typically, in a Code Division Multiple Access (CDMA) terminal, information about the mobile phone registration and authentication is stored in a mobile phone, but a mobile phone module, which is mounted in a telematics terminal for vehicles, cannot share a number with the user's mobile phone. Furthermore, in the case of a Wideband Code Division Multiple Access (WCDMA) High-Speed Downlink Packet Access (HSDPA) terminal, there exists a separate Universal Subscriber Identity Module (USIM). The USIM can support user authentication information and supplementary functions (for example, telephone directory storage, credit payment, etc.).

Although HSDPA technology may be applied to such a telematics terminal in the future, at present the details for an USIM interface method have not been determined. In the case of a European Global System for Mobile communications (GSM) terminal, which is based on technology similar to that of the telematics terminal, it can be difficult to determine the telematics terminal use environment, such as whether a vehicle engine has been started, and additionally there is concern about loss of a SIM module as a slot into which the SIM module is inserted is provided in the vehicle, but the SIM module must be stored separately.

In examples where Electronic Toll Collection (ETC) is used, and an additional payment means must be provided in a vehicle, which may cause an additional inconvenience to users. In this case, the number of payment means that are used by the users is increased because a mobile phone has a credit payment function, however a separate card is additionally used for payment in the ETC.

The above information disclosed in this the Background section is only for enhancement of understanding of the background of the invention and therefore it may contain information that does not form the prior art that is already known in this country to a person of ordinary skill in the art.

SUMMARY OF DISCLOSURE

The present invention preferably provides a smart key for vehicles and a telematics system using the same, in which a USIM interface is additionally provided in a vehicle, thus enabling the mobile phone number of a user to be suitably used for the telematics terminal without change.

In preferred embodiments, the present invention is directed to preferably providing a smart key for vehicles and a telematics system using the same, preferably in which a USIM interface is additionally provided in the smart key, thus suitably simplifying the vehicle USIM interface by extending an existing smart key communication mechanism and protocol.

In further preferred embodiments, the present invention is directed to providing a smart key for vehicles and a telematics system using the same, in which a USIM is suitably inserted into the smart key, which is always carried by the user, thus mitigating the problem of loss.

In other certain preferred embodiments, the present invention is directed to providing a smart key for vehicles and a telematics system using the same, which suitably enables the payment function of an HSDPA terminal to preferably operate in conjunction with ETC, thus providing the payment function.

In preferred embodiments, the present invention provides a smart key for vehicles, including, but not limited only to, a Radio Frequency (RF) Interface (I/F) unit for transmitting a radio signal to a smart key ECU, which is suitably provided in a vehicle; a smart key unit for suitably transmitting door lock/unlock signals to the RF I/F unit so that the RF I/F unit transmits the door lock/unlock signals to the smart key ECU; a USIM suitably inserted into a USIM interface unit provided in the smart key, preferably configured to be able to be coupled to a mobile communication terminal, and suitably configured to store USIM information therein; a USIM I/F unit for extracting the USIM information from the USIM; and a microcontroller for performing control so that the radio signal, which corresponds to the USIM information received from the USIM I/F unit, is suitably transmitted to the smart key ECU via the RF I/F unit.

In other preferred embodiments, the microcontroller may preferably include a storage unit for storing the USIM information.

Preferably, the USIM information may include both phone-related registration information and payment information.

In other embodiments, the mobile communication terminal, which is coupled with the USIM, may be a WCDMA HSDPA terminal.

In still other embodiments, the present invention preferably provides a telematics system for vehicles, including a vehicle smart key for suitably receiving USIM information from a USIM, which is preferably coupled with a mobile communication terminal, and transmitting a radio signal, which corresponds to the USIM information, the USIM being inserted into a USIM interface unit, which is preferably provided in the vehicle smart key; a smart key ECU provided in a vehicle to suitably receive the USIM information from the vehicle smart key; and a telematics terminal for performing a telematics function using the USIM information, which is suitably received from the smart key ECU.

In other preferred embodiments, the telematics system may further include an ETC unit for transmitting billing information to a tollgate billing system using the USIM information, which is suitably received from the smart key ECU.

Preferably, the USIM information may include both phone-related registration information and payment information.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other objects, features and advantages of the present invention will be more clearly understood from the following detailed description taken in conjunction with the accompanying drawings, which are given hereinafter by way of illustration only, and thus are not limitative of the present invention, and wherein.

DESCRIPTION

Figure 1:
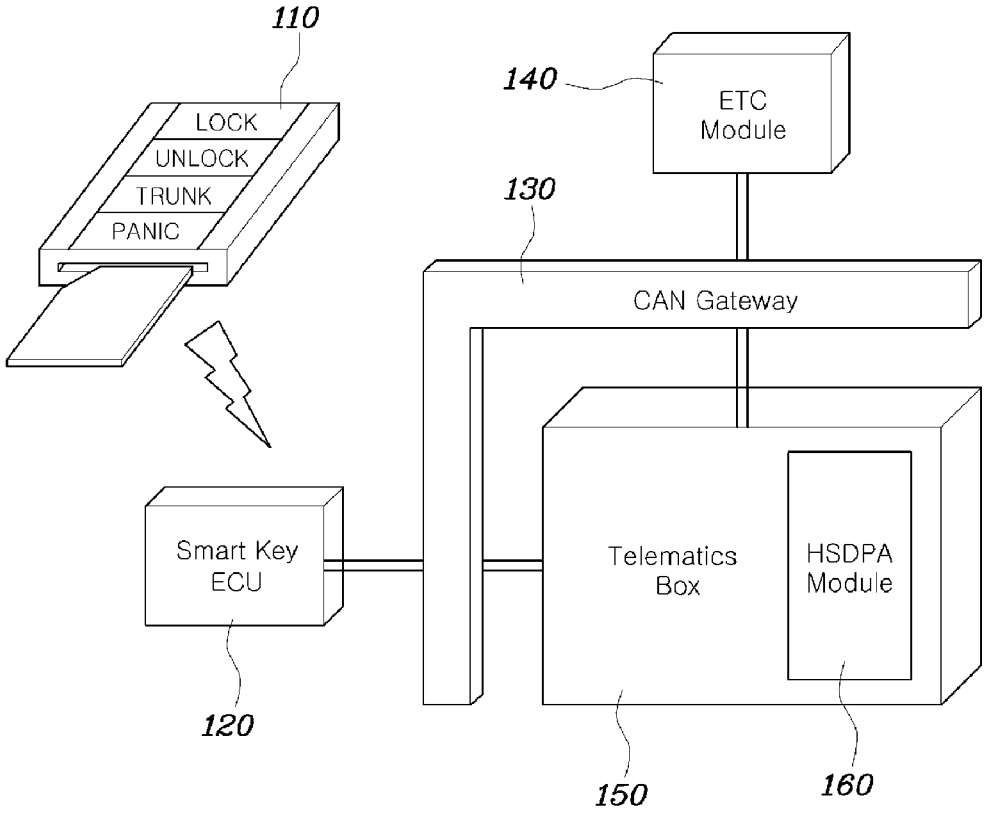
FIG. 1 is a diagram showing the construction of a telematics system for vehicles according to an embodiment of the present invention.

As described herein, the present invention features a smart key for vehicles, comprising a Radio Frequency (RF) Interface (I/F) unit for transmitting a radio signal to a smart key Electronic Control Unit (ECU), which is provided in a vehicle, a smart key unit, a Universal Subscriber Identity Module (USIM) inserted into a USIM interface unit provided in the smart key, and a USIM I/F unit for extracting the USIM information from the USIM.

In one embodiment, the smart key unit is used for transmitting door lock/unlock signals to the RF I/F unit so that the RF I/F unit transmits the door lock/unlock signals to the smart key ECU.

In another embodiment, the Universal Subscriber Identity Module (USIM) is configured to be able to be coupled to a mobile communication terminal, and configured to store USIM information therein.

In another particular embodiment, the smart key for vehicles further comprises a microcontroller for performing control so that the radio signal, which corresponds to the USIM information received from the USIM I/F unit, is transmitted to the smart key ECU via the RF I/F unit. In a related embodiment, the microcontroller comprises a storage unit for storing the USIM information.

The invention also features a motor vehicle comprising the smart key for vehicles as described in any of the aspects of the invention herein.

The present invention may be modified in various ways and may be implemented as various embodiments. Accordingly, specific embodiments are illustrated in the drawings and will be described in detail in the specification. However, it should be understood that this is not intended to limit the present invention only to the specific embodiments, and that modifications, equivalents, and substitutions are all included in the spirit and technical scope of the present invention.

As long as they are not defined otherwise, all of the terms that are used herein, including technical or scientific terms, have the same meanings as those that are generally understood by a person having ordinary knowledge in the technical field to which the present invention pertains. Generally, the terms, which are the same as those defined in usable dictionaries, are to be interpreted as having meanings identical to those in the contexts of related arts, and are not to be interpreted according to ideally or excessively formal meanings when they are not defined clearly in the present application.

Furthermore, when a description is given with reference to the accompanying drawings, the same reference numerals are assigned to the same components for all drawings, and repeated descriptions thereof will be omitted. In the description of the present invention, when it is determined that detailed descriptions of related well-known technology would make the gist of the present invention unclear, such descriptions are omitted.

FIG. 1 is an exemplary diagram showing the preferred construction of a telematics system for vehicles according to a preferred embodiment of the present invention;

Referring to FIG. 1, the telematics system preferably includes a smart key 110, a smart key ECU 120, a CAN gateway 130, an ETC module 140, a telematics terminal 150, and an HSDPA module 160.

In certain embodiments, the smart key 110 is preferably provided with a slot so that a user can remove a USIM from his or her mobile communication terminal and then suitably insert it into the slot. In particular preferred examples, it is not necessary for a user to suitably conduct a separate procedure of registering the telematics terminal 150. In other further embodiments, the telematics terminal 150 can be immediately used when a USIM card is suitably inserted thereinto and thus provides certain advantages to the user. In further embodiments, the smart key 110 reads USIM information from the USIM and then suitably transmits the read USIM information to the smart key ECU 120, which is preferably provided in a vehicle.

In certain preferred embodiments of the invention, the smart key ECU 120 processes the USIM information, which is received from the smart key 110 via the RF I/F unit of the smart key ECU 120, into a CAN message and then suitably transmits the CAN message to the telematics terminal 150.

Preferably, the ETC module 140 performs communication with the billing system of a tollgate via a DSRC I/F unit 513.

In further embodiments, the telematics terminal 150 may preferably perform a general telematics function. In particular, in certain embodiments, the telematics terminal 150 may preferably perform a function as the user's mobile phone in the state in which the USIM is mounted in the smart key 110. Preferably, the HSDPA module 160 may provide a suitable phone calling function using the USIM information.

Figure 2:
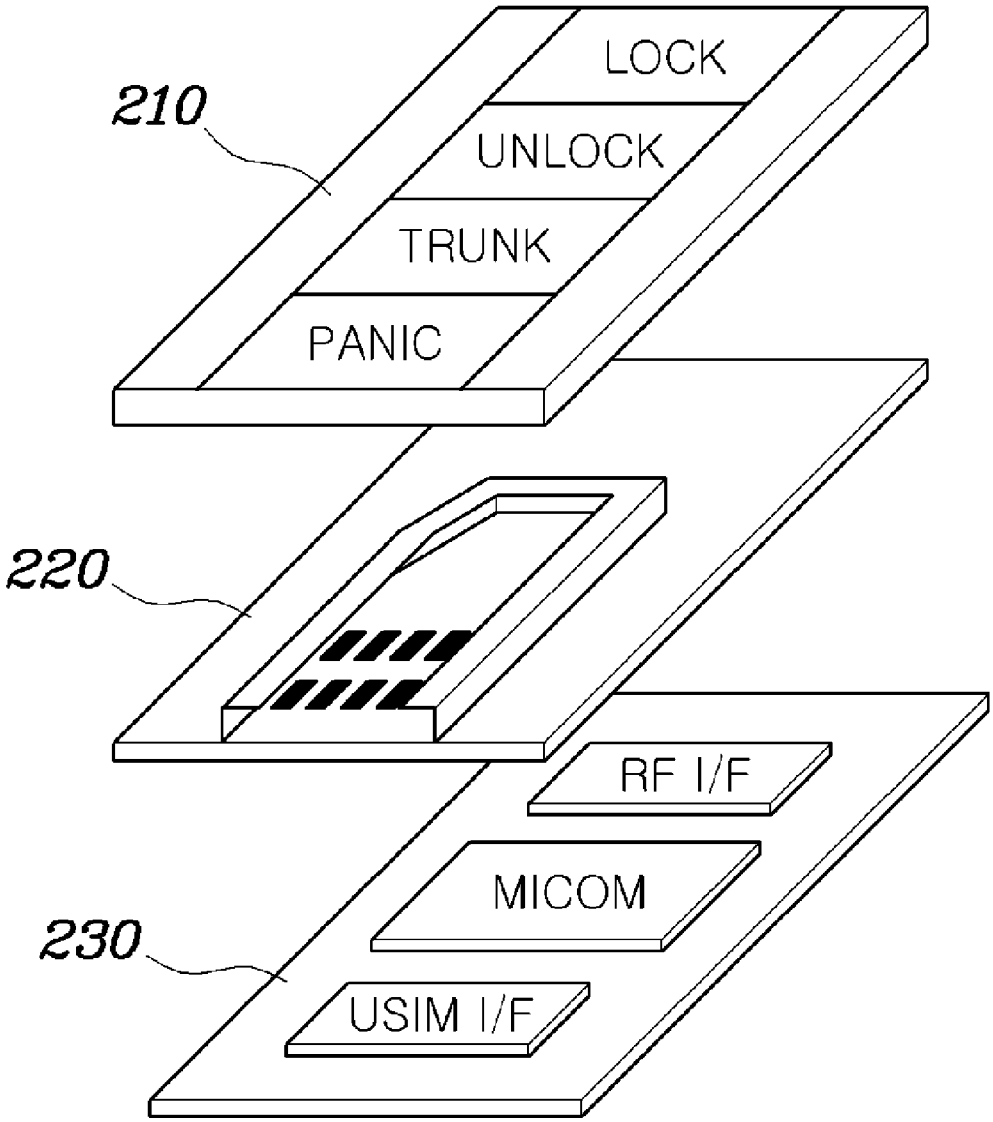
FIG. 2 is a diagram showing the construction of a smart key for vehicles according to an embodiment of the present invention.

FIG. 2 is an exemplary diagram showing a preferred construction of the smart key 110 for vehicles according to a further embodiment of the present invention. Referring to FIG. 2, the smart key 110 preferably includes a smart key unit 210, a USIM interface unit 220, and a circuit unit 230.

In other preferred embodiments, the smart key unit 210 may include, but is not limited to, door lock/unlock buttons, a trunk button, and a panic button. The present invention is not limited to the buttons shown in the drawing, and various buttons may be provided in the smart key unit 210. Preferably, the smart key unit 210 transmits door lock/unlock signals to the RF I/F unit of the smart key unit 210 so that the RF I/F unit of the smart key unit 210 can suitably transmit the door lock/unlock signals to the smart key ECU 120.

In further embodiments, the USIM interface unit 220 is configured such that the USIM is suitably inserted thereinto. Preferably, the USIM may be suitably coupled to the user's mobile communication terminal. Preferably, the user may suitably insert a USIM, which is provided in his or her mobile communication terminal, into the USIM interface unit 220 according to preferred embodiments of the present invention for use thereof.

In other embodiments of the invention, the circuit unit 230 may include, but is not limited to, an RF I/F unit, a microcontroller, and a USIM I/F unit. In further embodiments, the RF I/F unit transmits a radio signal to the smart key ECU 120, which is suitably provided in the vehicle. Preferably, the USIM I/F unit extracts the USIM information from the USIM and suitably transmits the extracted USIM information to the microcontroller. Preferably, the USIM information may include, for example, phone-related registration information and payment information. The phone-related registration information may preferably include a phone number and user information so that the telematics terminal 150 can suitably perform a phone calling function. In further embodiments, the payment information may be numerical information, and is suitably used for the user to make specific payment using a telephone.

In other further embodiments, the microcontroller transmits the radio signal, which corresponds to the USIM information received from the USIM I/F unit, to the smart key ECU 120 via the RF I/F unit. In further embodiments, the protocol for transmitting the USIM information may be achieved by suitably extending an existing protocol for use thereof. For example, the microcontroller may further include a storage unit for storing the USIM information.

Figure 3:
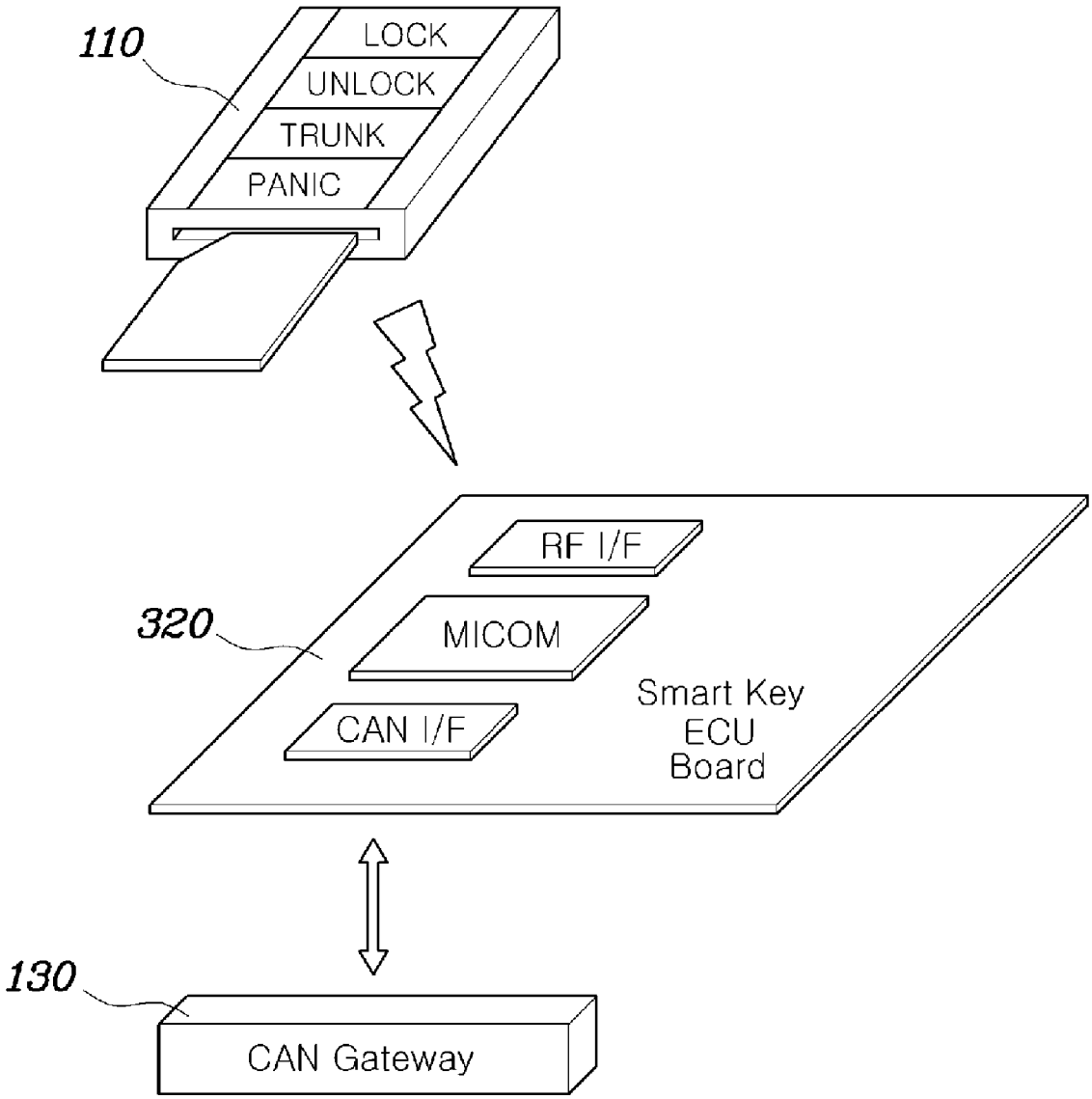
FIG. 3 is a diagram illustrating the transmission and reception of signals between the smart key according to the embodiment of the present invention and a Controller Area Network (CAN) gateway.

FIG. 3 is an exemplary diagram illustrating the preferred transmission and reception of signals between the smart key according to other preferred embodiments of the present invention and a CAN gateway. Referring to FIG. 3, in certain embodiments, a smart key ECU board 320 is located between the smart key 110 and the CAN gateway 130.

According to the invention as described herein, the smart key ECU board 320 preferably includes a CAN I/F unit, an RF I/F unit, and a smart key ECU microcontroller.

Preferably, the CAN I/F unit suitably processes the USIM information, which is received from the smart key 110 via the RF I/F unit, into a CAN message, and then suitably transmits the CAN message to the telematics terminal 150. According to further embodiments, the CAN message is preferably transmitted to the telematics terminal 150 via the CAN gateway 130, which is suitably provided in a vehicle.

According to embodiments of the invention as described herein, when the smart key 110 suitably transmits the USIM information, which is collected via a USIM I/F circuit, preferably using a radio signal, the RF I/F unit suitably receives the corresponding information and transmits the received information to the smart key ECU microcontroller.

Preferably, the smart key ECU microcontroller processes the USIM information, which is suitably received in the form of an RF signal, into a CAN message, and suitably transmits the CAN message to the CAN I/F unit. In further embodiments, the microcontroller determines whether a USIM is mounted in the slot using a status message, which is transmitted by the smart key 110. Preferably, if it is determined that no USIM is currently mounted, the microcontroller suitably transmits a corresponding status to the telematics terminal 150 via a CAN, and thus the telematics terminal 150 can deactivate a phone-related function.

Figure 4:
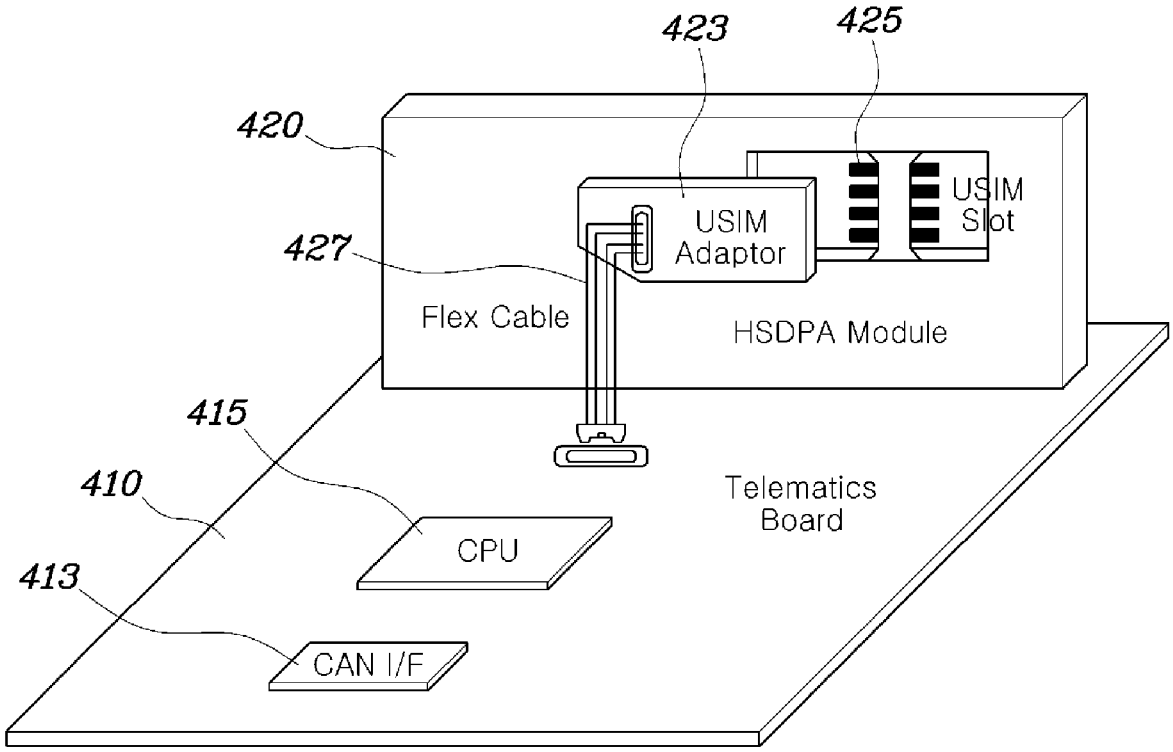
FIG. 4 is a diagram showing the construction of a telematics terminal for vehicles according to an embodiment of the present invention.

FIG. 4 is an exemplary diagram showing the preferred construction of the telematics terminal 150 for vehicles according to certain preferred embodiments of the present invention. Referring to FIG. 4, the telematics terminal 150 preferably includes, but may not be limited only to, a telematics board 410, a CAN I/F unit 413, a Central Processing Unit (CPU) 415, an HSDPA module 420, a USIM adapter 423, a USIM slot 425, and a flexible cable 427.

In further related embodiments, the CPU 415 activates the HSDPA module 420, which is suitably mounted in the telematics terminal 150, using the USIM information, which is transmitted from the smart key ECU 120.

Preferably, the telematics terminal 150 may perform a general telematics function. In further embodiments, the telematics terminal 150 may perform a function as the user's mobile phone in the state in which the USIM is suitably mounted in the smart key 110. In certain embodiments of the invention, where the smart key 110 cannot be used because the smart key 110 is spaced apart from the vehicle or because the vehicle is in an ACC Off state, the phone function of the telematics terminal 150 may be suitably deactivated.

In other preferred embodiments, on the telematics board 410, the USIM adapter 423 is suitably connected to the HSDPA module 420 using the flexible cable 427.

In certain preferred embodiments of the invention, the CPU 415 collects the USIM information, which is suitably acquired from the smart key 110 using the USIM adapter 423, preferably via the CAN I/F unit 413, and suitably transmits the collected USIM information to the HSDPA module 420. Accordingly, in further embodiments, the HSDPA module 420 can be switched to a state in which it can be operated. Preferably, the USIM slot 425 may be provided such that a function of directly inserting an existing USIM can be suitably performed.

Figure 5:
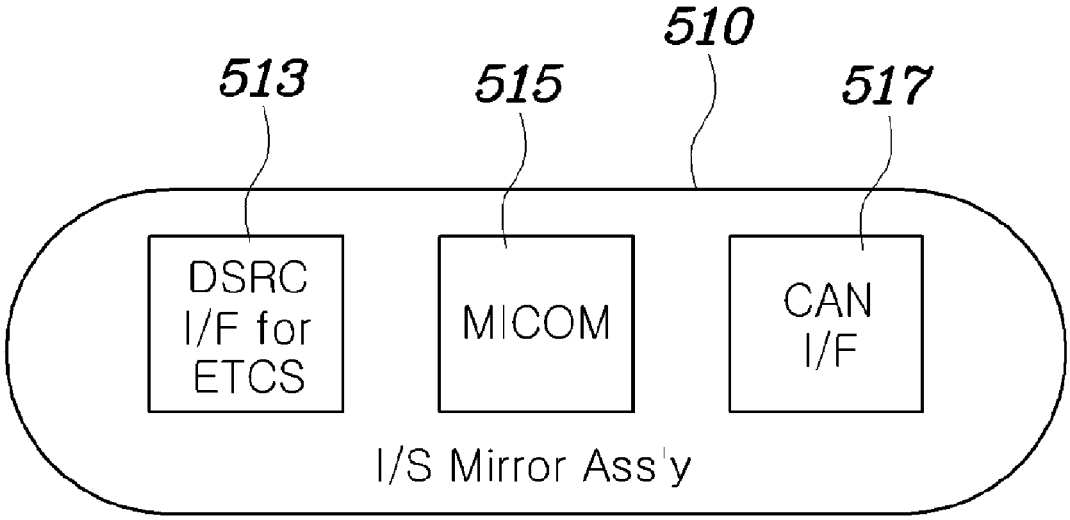
FIG. 5 is a diagram showing the construction of an ETC module according to an embodiment of the present invention.

FIG. 5 is an exemplary diagram showing the construction of an ETC module according to another preferred embodiment of the present invention. Referring to FIG. 5, the ECT module 510 preferably includes a DSRC I/F unit 513, an ETC microcontroller 515, and a CAN I/F unit 517.

In preferred embodiments, the ETC module 510 according to the present invention may have the same structure as that of an existing ETC module. In certain preferred embodiments, the ETC module 510 suitably performs communication with the billing system of a tollgate via the DSRC I/F unit 513. In other preferred embodiments, the ETC microcontroller 515 may suitably function as a toll payment card interface.

According to other certain embodiments of the present invention, an existing toll payment card interface part may not be necessary. Preferably, for example in the case of an existing ETC device, billing is suitably performed, for example independently performed, in the state in which a toll payment card is suitably inserted into the ETC device. Preferably, in the present invention, no ETC card interface is suitably provided in the ETC module.

In preferred embodiments of the invention, the CAN I/F unit 517, which is additionally suitably provided in the ETC module instead of such a card interface, preferably transmits billing information, which is received from a tollgate, to the telematics terminal 150 in the form of a CAN message under the control of the ETC microcontroller 515.

In further embodiments, for example preferably in the case where the telematics terminal 150 cannot be used because no USIM is suitably inserted, the telematics terminal 150 may provide a suitable warning to the user while performing an error processing function. Accordingly, in further embodiments, when a warning has been suitably provided, the driver must use a normal lane, rather than using an ETC lane.

Figure 6:
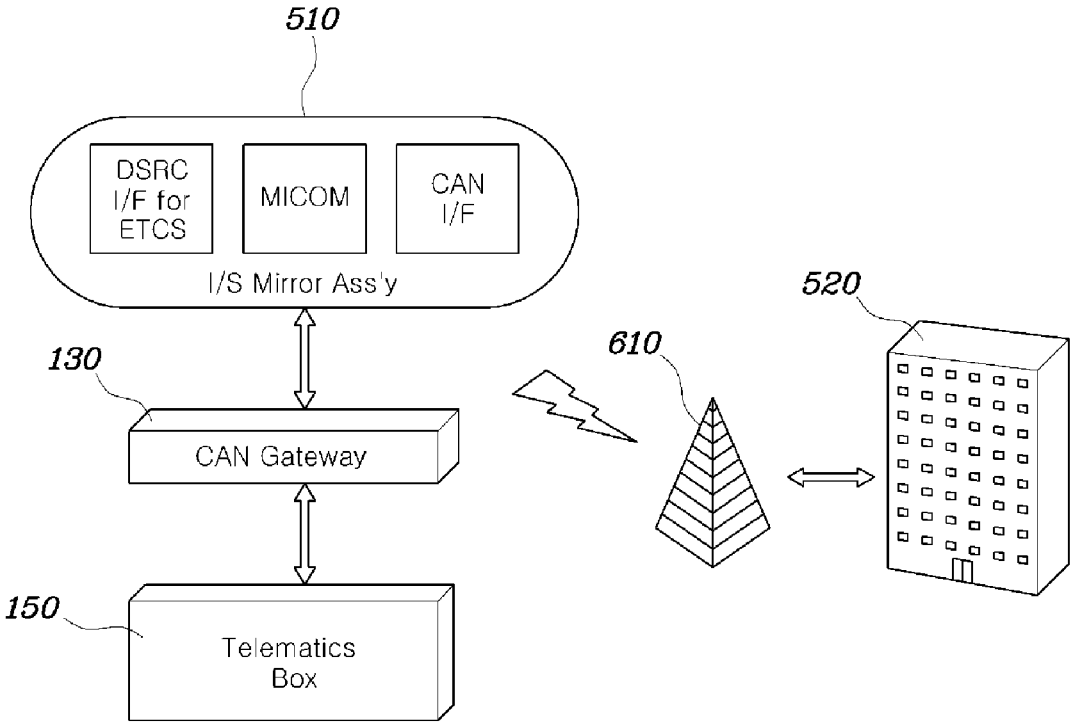
FIG. 6 is a diagram showing a billing system using the ETC module according to the embodiment of the present invention.

FIG. 6 is an exemplary diagram showing a preferred billing system using the ETC module according to other preferred embodiments of the present invention. Referring to FIG. 6, the billing system preferably includes, but is not only limited to, an ETC module 510, a CAN gateway 130, a telematics terminal 150, an HSDPA network 610, and a mobile communication company billing system 620.

In preferred embodiments of the invention as described herein, the mobile communication company billing system 620 performs payment using the billing information, which is suitably received from the ETC module 510. Preferably, the billing information may be suitably transmitted using the USIM information via an HSDPA modem. For example, in further embodiments, an amount of money, which is paid as described above, may be integrally billed together with the user's mobile communication bill.

Detailed descriptions of a signal system for the smart key for vehicles and the telematics system using the same according to the embodiment of the preset invention, as well as detailed descriptions of other technologies for the smart key for vehicles and the telematics system using the same according to the embodiment of the preset invention, that is, common platform technology using an embedded system and an O/S, interface standardization technology using communication protocols and I/O interfaces, and technology for standardizing components, such as a battery, are omitted.

In the smart key for vehicles and the telematics system using the same, according to preferred embodiments of the present invention, the USIM interface is additionally provided in a vehicle, so that the mobile phone number of a user can be used for the telematics terminal without change.

In certain preferred embodiments, in the smart key for vehicles and the telematics system using the same, according to the present invention, preferably the USIM interface is additionally provided in the smart key, so that the vehicle USIM interface can be suitably simplified by extending an existing smart key communication mechanism and protocol.

In other certain preferred embodiments, in the smart key for vehicles and the telematics system using the same, according to the present invention, the USIM is suitably inserted into the smart key, which is carried by the user, so that the problem of the loss thereof can be overcome.

Furthermore, in the smart key for vehicles and the telematics system using the same, according to the present invention, the payment function of an HSDPA terminal preferably operates in conjunction with ETC, so that the payment function can be suitably provided.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A smart key for vehicles, comprising:

a Radio Frequency (RF) Interface (I/F) unit for transmitting a radio signal to a smart key Electronic Control Unit (ECU), which is provided in a vehicle;

a smart key unit for transmitting door lock/unlock signals to the RF I/F unit so that the RF I/F unit transmits the door lock/unlock signals to the smart key ECU;

a Universal Subscriber Identity Module (USIM) inserted into a USIM interface unit provided in the smart key, configured to be able to be coupled to a mobile communication terminal, and configured to store USIM information therein;

a USIM I/F unit for extracting the USIM information from the USIM; and a microcontroller for performing control so that the radio signal, which corresponds to the USIM information received from the USIM I/F unit, is transmitted to the smart key ECU via the RF I/F unit.

2. The smart key as set forth in claim 1, wherein the microcontroller comprises a storage unit for storing the USIM information.

3. The smart key as set forth in claim 1, wherein the USIM information comprises both phone-related registration information and payment information.

4. The smart key as set forth in claim 1, wherein the mobile communication terminal, which is coupled with the USIM, is a Wideband Code Division Multiple Access (WCDMA) High-Speed Downlink Packet Access (HSDPA) terminal.

5. A telematics system for vehicles, comprising:

a vehicle smart key for receiving USIM information from a USIM, which is coupled with a mobile communication terminal, and transmitting a radio signal, which corresponds to the USIM information, the USIM being inserted into a USIM interface unit, which is provided in the vehicle smart key;

a smart key ECU provided in a vehicle to receive the USIM information from the vehicle smart key; and a telematics terminal for performing a telematics function using the USIM information, which is received from the smart key ECU.

6. The telematics system as set forth in claim 5, further comprising:

an Electronic Toll Collection (ETC) unit for transmitting billing information to a tollgate billing system using the USIM information, which is received from the smart key ECU.

7. The telematics system as set forth in claim 5, wherein the USIM information comprises both phone-related registration information and payment information.

8. A smart key for vehicles, comprising:

a Radio Frequency (RF) Interface (I/F) unit for transmitting a radio signal to a smart key Electronic Control Unit (ECU), which is provided in a vehicle;

a smart key unit;

a Universal Subscriber Identity Module (USIM) inserted into a USIM interface unit provided in the smart key; and a USIM I/F unit for extracting the USIM information from the USIM.

9. The smart key for vehicles of claim 8, wherein the smart key unit is used for transmitting door lock/unlock signals to the RF I/F unit so that the RF I/F unit transmits the door lock/unlock signals to the smart key ECU.

10. The smart key for vehicles of claim 8, wherein the Universal Subscriber Identity Module (USIM) is configured to be able to be coupled to a mobile communication terminal, and configured to store USIM information therein.

11. The smart key for vehicles of claim 8, further comprising a microcontroller for performing control so that the radio signal, which corresponds to the USIM information received from the USIM I/F unit, is transmitted to the smart key ECU via the RF I/F unit.

12. The smart key for vehicles of claim 11, wherein the microcontroller comprises a storage unit for storing the USIM information.

13. A motor vehicle comprising the smart key for vehicles of claim 1.

14. A motor vehicle comprising the smart key for vehicles of claim 8.

* * * * *